US009546028B2

(12) United States Patent
Aoe et al.

(10) Patent No.: US 9,546,028 B2
(45) Date of Patent: Jan. 17, 2017

(54) MOUTHPIECE STRUCTURE FOR PRESSURE VESSEL

(71) Applicants: FTS CO., LTD., Toyota-shi, Aichi-ken (JP); TOYOTA JIDOSHA KABUSHIKI KAISHA, Toyota-shi, Aichi-ken (JP)

(72) Inventors: Ryuta Aoe, Nagoya (JP); Yoshinori Miyazaki, Nagoya (JP); Katsuya Manabe, Toyokawa (JP); Masayoshi Takami, Hamamatsu (JP); Masayoshi Taki, Konan (JP); Ken Hatta, Okazaki (JP)

(73) Assignees: FTS CO., LTD., Toyota-shi, Aichi-ken (JP); Toyota Jidosha Kabushiki Kaisha, Toyota-shi, Aichi-ken (JP)

( * ) Notice: Subject to any disclaimer, the term of this patent is extended or adjusted under 35 U.S.C. 154(b) by 38 days.

(21) Appl. No.: 14/565,393

(22) Filed: Dec. 9, 2014

(65) Prior Publication Data

US 2015/0166233 A1 Jun. 18, 2015

(30) Foreign Application Priority Data

Dec. 13, 2013 (JP) ..... 2013-258376

(51) Int. Cl.
*B65D 53/02* (2006.01)
*B65D 81/20* (2006.01)
(Continued)

(52) U.S. Cl.
CPC ..... *B65D 53/02* (2013.01); *B65D 25/14* (2013.01); *B65D 81/20* (2013.01); *F17C 13/001* (2013.01);
(Continued)

(58) Field of Classification Search
CPC ..... B65D 53/02; B65D 25/14; B65D 81/20; F17C 13/06; F17C 13/04; F17C 1/02; F17C 1/00; F17C 1/16
See application file for complete search history.

(56) References Cited

U.S. PATENT DOCUMENTS 5,429,845 A 7/1995 Newhouse et al.
5,938,209 A 8/1999 Sirosh et al.
(Continued)

FOREIGN PATENT DOCUMENTS

CN 1074281 A 7/1993
CN 200940767 Y 8/2007
(Continued)

*Primary Examiner* — Andrew Perreault
(74) *Attorney, Agent, or Firm* — Finnegan, Henderson, Farabow, Garrett & Dunner, LLP

(57) ABSTRACT

A mouthpiece structure for a pressure vessel includes a liner constituting a vessel body and a cylindrical part, a cylindrical mouthpiece mounted closely to an inner periphery of the cylindrical part, a housing part having a housing recess formed by recessing at least one of the inner periphery of cylindrical part and an outer periphery of mouthpiece, a sealing member housed in the housing recess while adhering closely to the inner periphery of cylindrical part and the outer periphery of mouthpiece, the sealing member defining a sealed space facing an interface between the inner periphery of the cylindrical part and the outer periphery of the mouthpiece in the housing recess, and a retainer located opposite the sealed space with the sealing member being interposed between them and preventing the sealing member from being displaced in a direction such that the sealing member increases a capacity of the sealed space.

6 Claims, 14 Drawing Sheets

(51) Int. Cl.

| | |
|---|---|
| ***B65D 25/14*** | (2006.01) |
| ***F17C 13/00*** | (2006.01) |
| ***F17C 13/06*** | (2006.01) |

(52) U.S. Cl.

CPC ..... *F17C 13/06* (2013.01); *F17C 2201/0109* (2013.01); *F17C 2201/056* (2013.01); *F17C 2201/058* (2013.01); *F17C 2203/0604* (2013.01); *F17C 2203/066* (2013.01); *F17C 2203/0619* (2013.01); *F17C 2205/0305* (2013.01); *F17C 2205/0397* (2013.01)

(56) References Cited

U.S. PATENT DOCUMENTS

| | | | | |
|---|---|---|---|---|
| 7,857,159 | B2 * | 12/2010 | Lindner | F16J 15/062 220/586 |
| 8,186,536 | B2 * | 5/2012 | Strack | F17C 1/00 220/586 |
| 8,967,417 | B2 * | 3/2015 | Sharp | F17C 1/16 220/203.25 |
| 2011/0108557 | A1 * | 5/2011 | Tani | F17C 1/16 220/586 |
| 2014/0061207 | A1 * | 3/2014 | Kloft | F15B 1/165 220/586 |

FOREIGN PATENT DOCUMENTS

| | | |
|---|---|---|
| JP | 11-13995 | 1/1999 |
| JP | 2005-265138 A | 9/2005 |
| JP | 2013-036603 | 2/2013 |

* cited by examiner

MOUTHPIECE STRUCTURE FOR PRESSURE VESSEL

CROSS REFERENCE TO RELATED APPLICATIONS

This application is based upon and claims the benefit of priority from the prior Japanese Patent Application No. 2013-258376 filed on Dec. 13, 2013, the entire contents of which are incorporated herein by reference.

BACKGROUND

1. Technical Field

The present invention relates to a mouthpiece structure for a pressure vessel.

2. Related Art

Japanese Patent Application Publication No. JP-A-H11-13995 discloses a mouthpiece structure for a pressure vessel, which includes a liner made of a synthetic resin and constructing a vessel body and a cylindrical part communicating between an interior and an exterior of the vessel body, a cylindrical mouthpiece mounted to an inner periphery of the cylindrical part and a sealing member preventing a fluid in the vessel body from leaking through a gap between the inner periphery of the cylindrical part and an outer periphery of the mouthpiece. As shown in FIG. 13, the cylindrical part 101 of the liner 100 has a distal end surface 102. The mouthpiece 103 also has a distal end surface 104 which is adjacent to the distal end surface 102 so that both distal end surfaces 102 and 104 are coplanar. A gap between the adjacent distal end surfaces 102 and 104 serves as a leak outlet 106 through which the fluid leaking through an interface 105 between the inner periphery of the cylindrical part 101 and the outer periphery of the mouthpiece 103 flows outside the vessel. The sealing member 107 is disposed so as to close the leak outlet 106.

When the pressure of the fluid leaking through the gap between the inner periphery of the cylindrical part 101 and the outer periphery of the mouthpiece 103 is excessively large, there is a possibility that the sealing member 107 subjected to the fluid pressure would be irregularly deformed in a direction away from the leak outlet 106 while being axially pressed, as shown in FIG. 14. This irregular deformation of the sealing member 107 renders the leak outlet 106 open to the outside, resulting in loss of the sealing function.

SUMMARY

Therefore, an object of the invention is to provide a mouthpiece structure for the pressure vessel, which can improve the reliability of the sealing performance.

The invention provides a mouthpiece structure for a pressure vessel, comprising a liner made of a synthetic resin and constituting a vessel body and a cylindrical part communicating between an interior and an exterior of the vessel body, a cylindrical mouthpiece mounted closely to an inner periphery of the cylindrical part, a housing part having a housing recess formed by recessing at least one of the inner periphery of the cylindrical part and an outer periphery of the mouthpiece, the housing recess being open to an external surface intersecting with axis lines of the cylindrical part and the mouthpiece, a sealing member housed in the housing recess while adhering closely to the inner periphery of the cylindrical part and the outer periphery of the mouthpiece, the sealing member defining a sealed space facing an interface between the inner periphery of the cylindrical part and the outer periphery of the mouthpiece in the housing recess, and a retainer provided opposite the sealed space with the sealing member being interposed therebetween and preventing the sealing member from being displaced in a direction such that the sealing member increases a capacity of the sealed space.

The sealing member blocks in the sealed space a fluid flowing from the interior of the vessel body into the housing recess through the gap in the interface between the cylindrical part and the mouthpiece. As a result, the fluid can be prevented from leaking outside the cylindrical part and the mouthpiece. When the pressure of the fluid flowing into the sealed space becomes excessively large, the sealing member is elastically deformed so as to be pressed in the direction of axis line between the fluid and the retainer. An adhering force of the sealing member to the inner periphery of the cylindrical part and the outer periphery of the mouthpiece is increased with this elastic deformation of the sealing member. This can reliably prevent fluid leakage.

Figure 3:
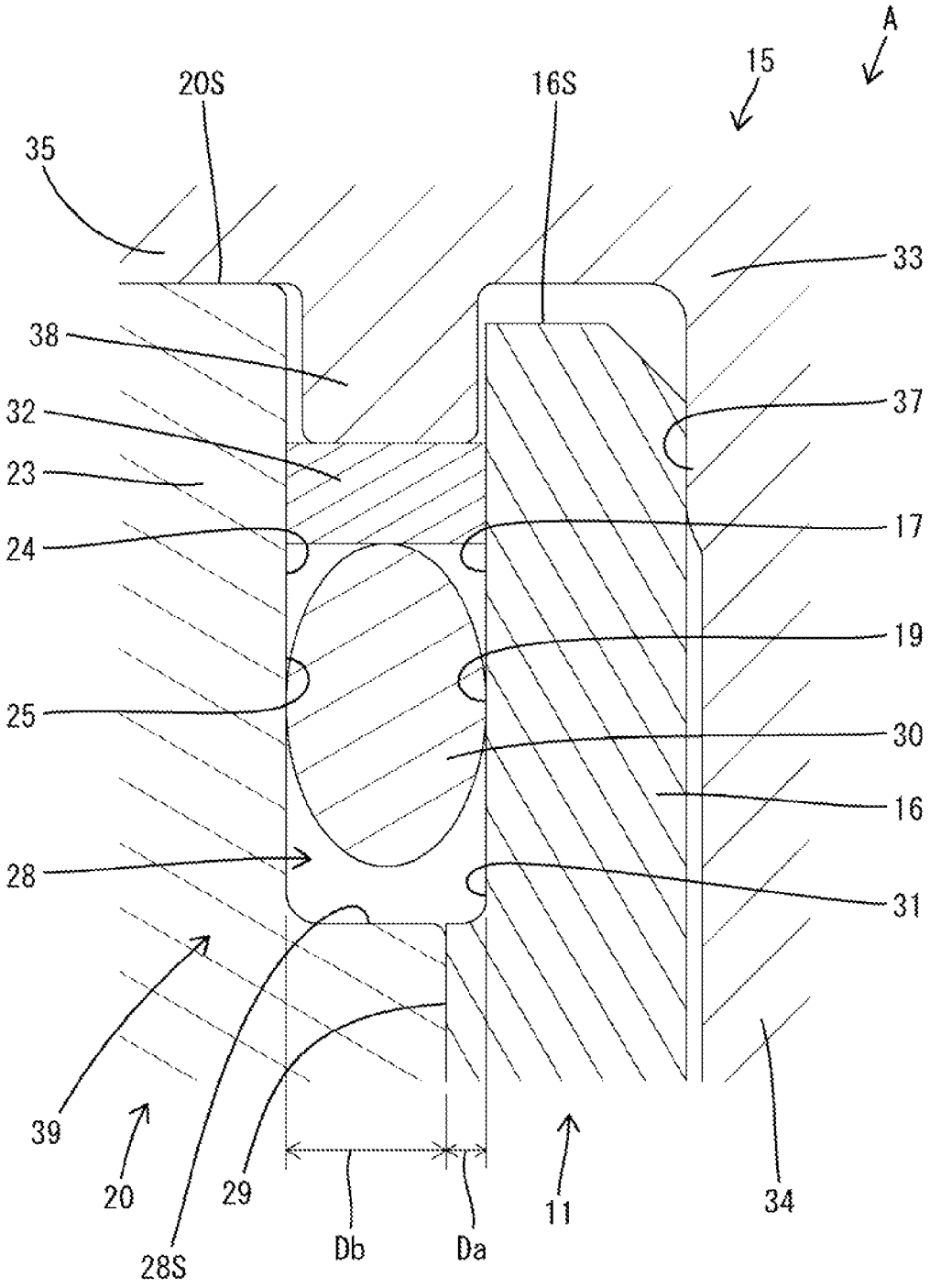
Figure 4:
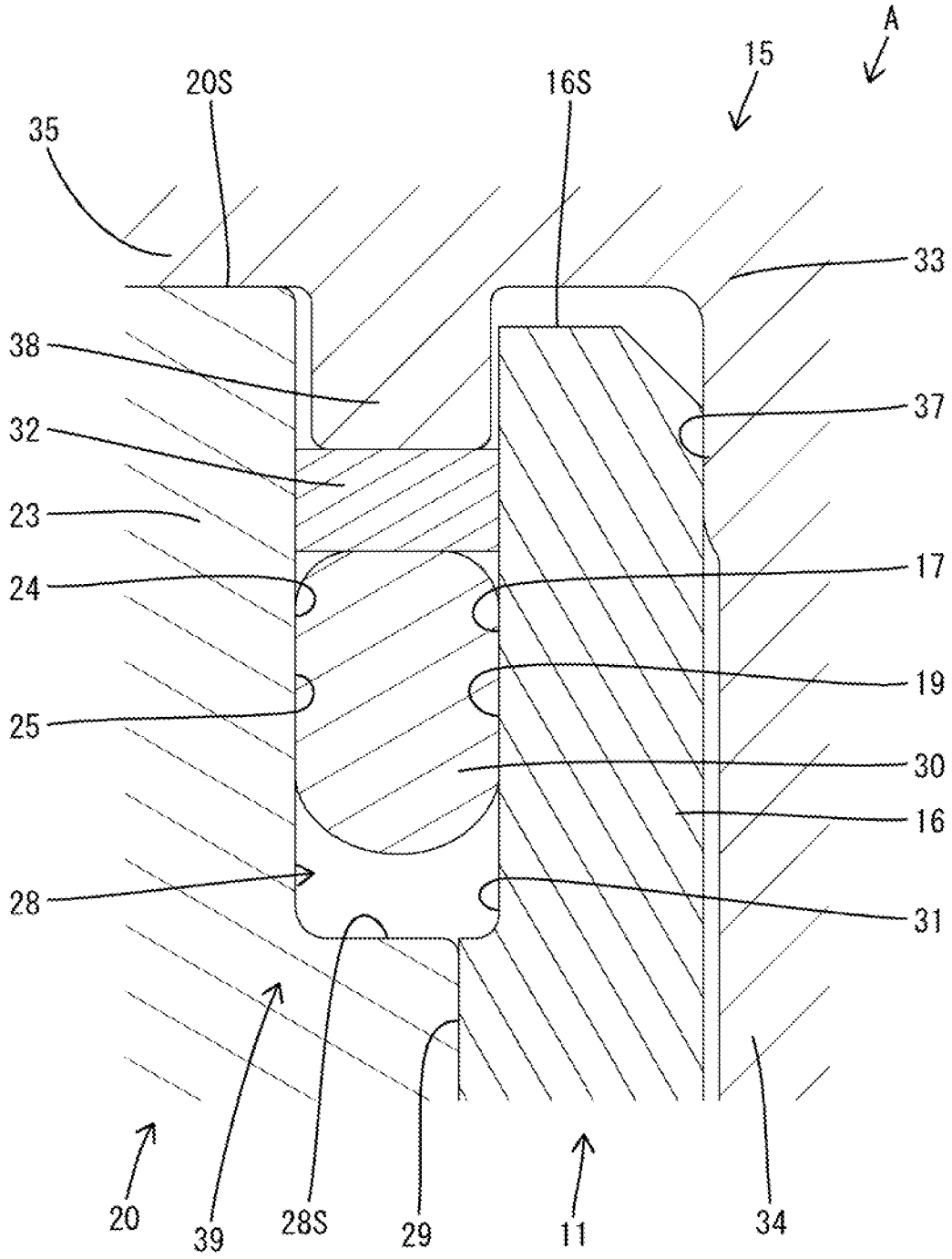
Figure 5:
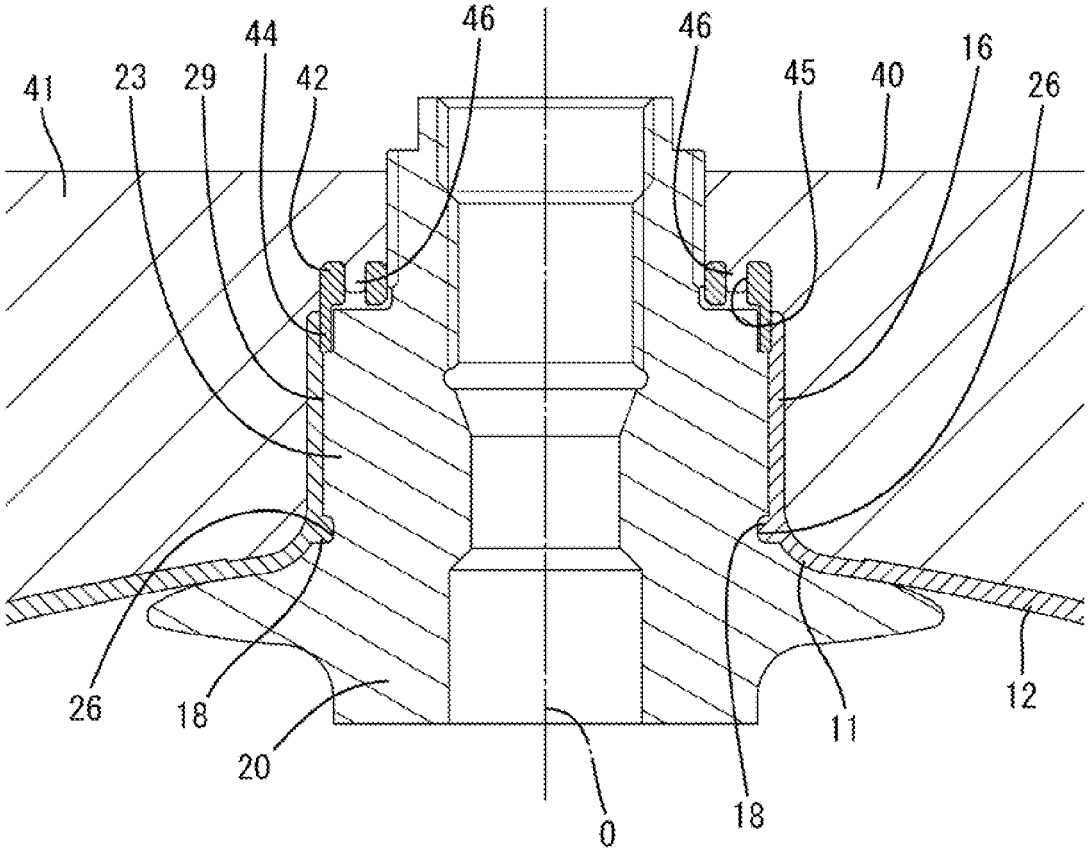
Figure 6:
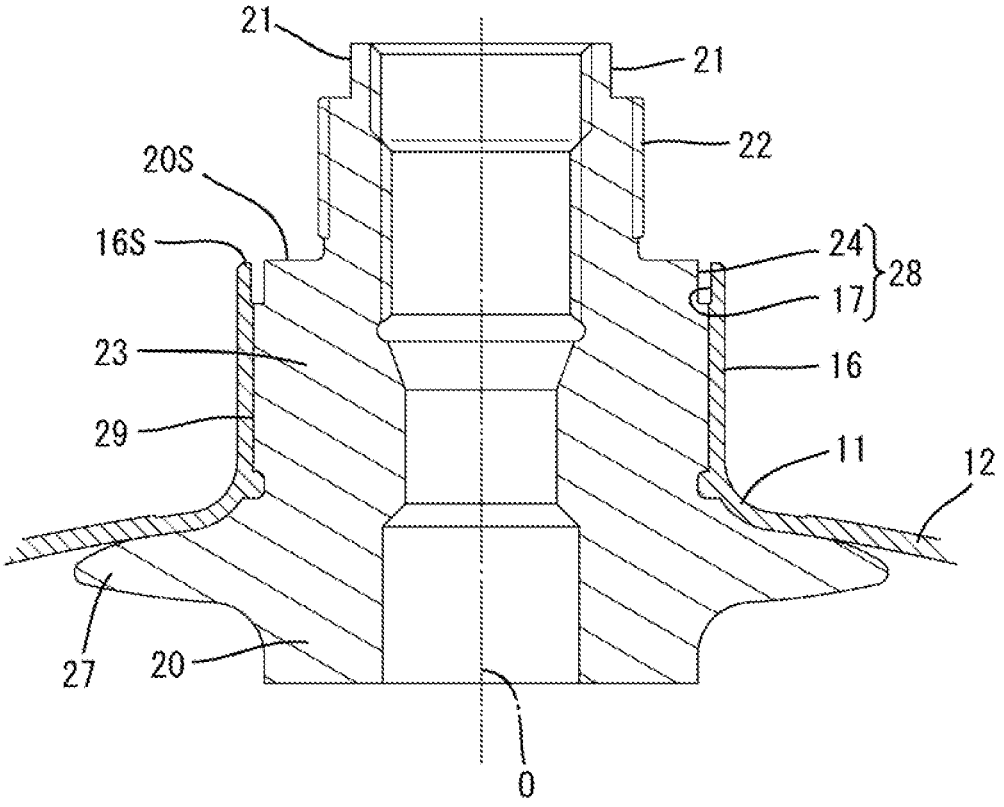
Figure 7:
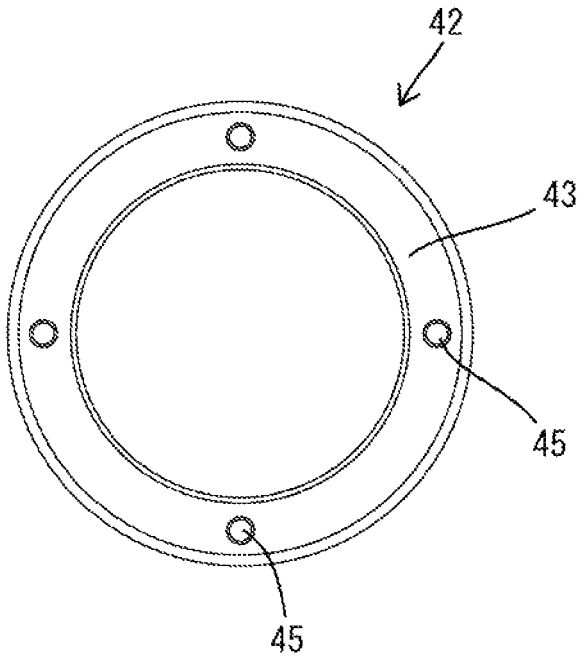
Figure 8:
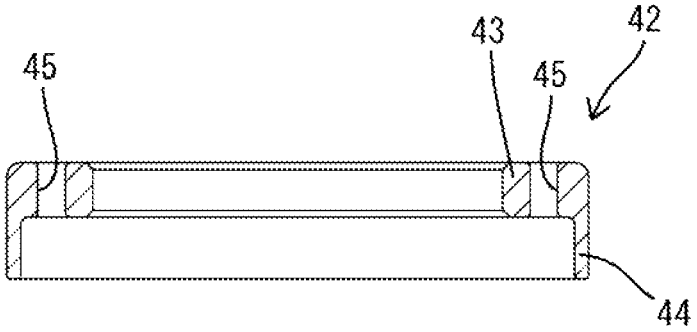
Figure 9:
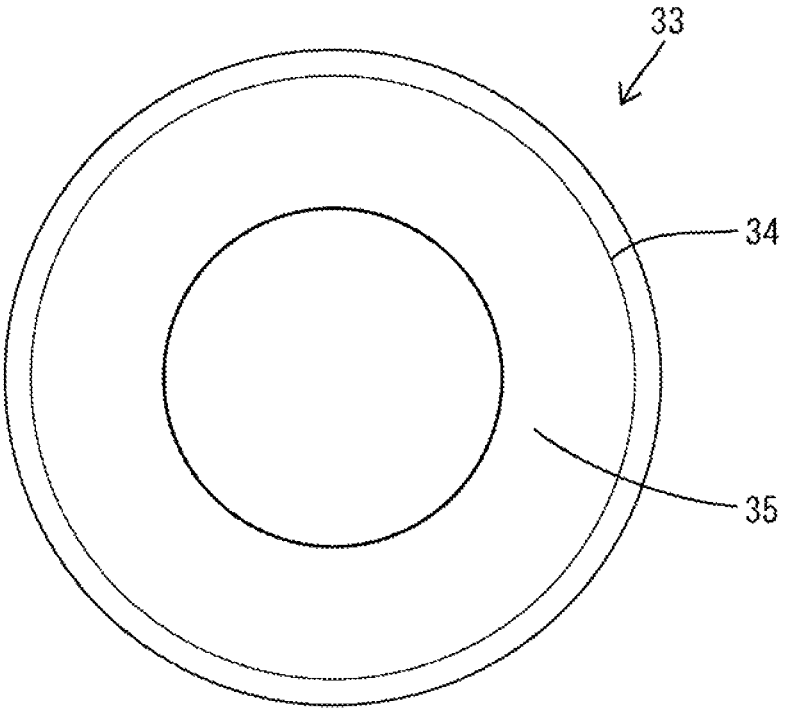
Figure 10:
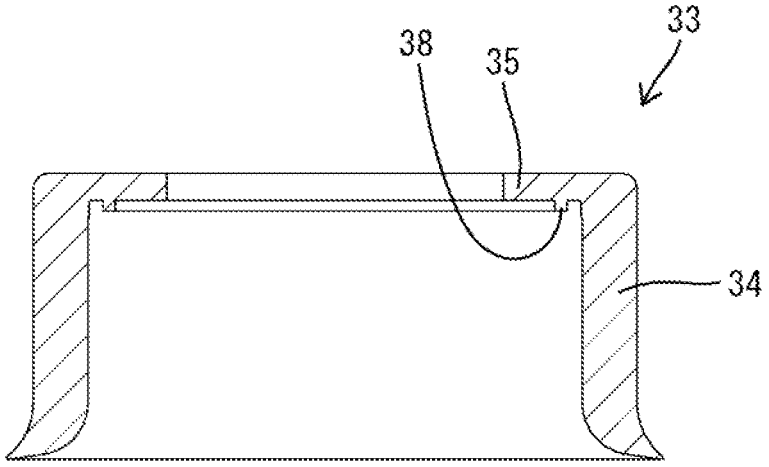
Figure 11:
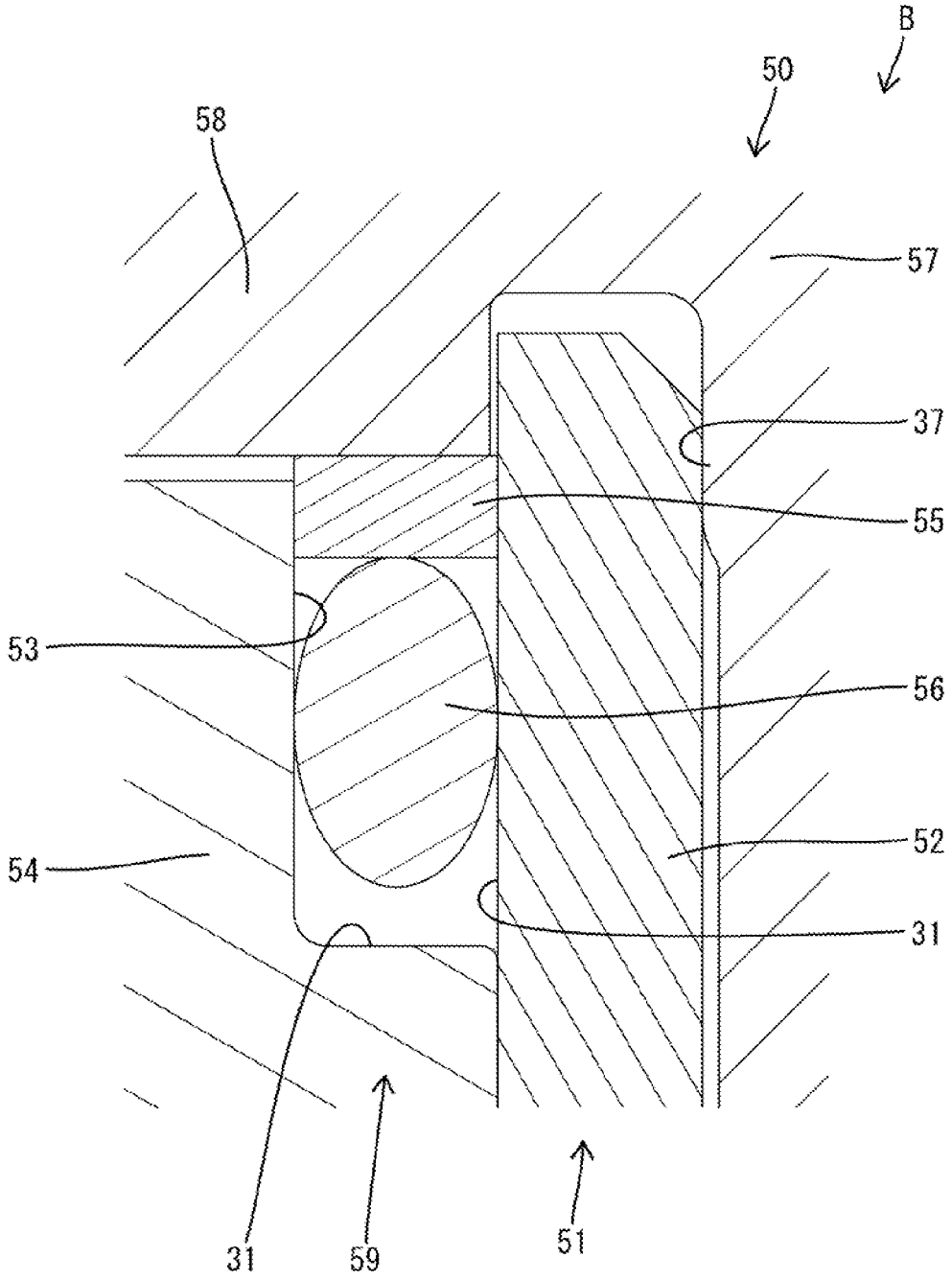
Figure 12:
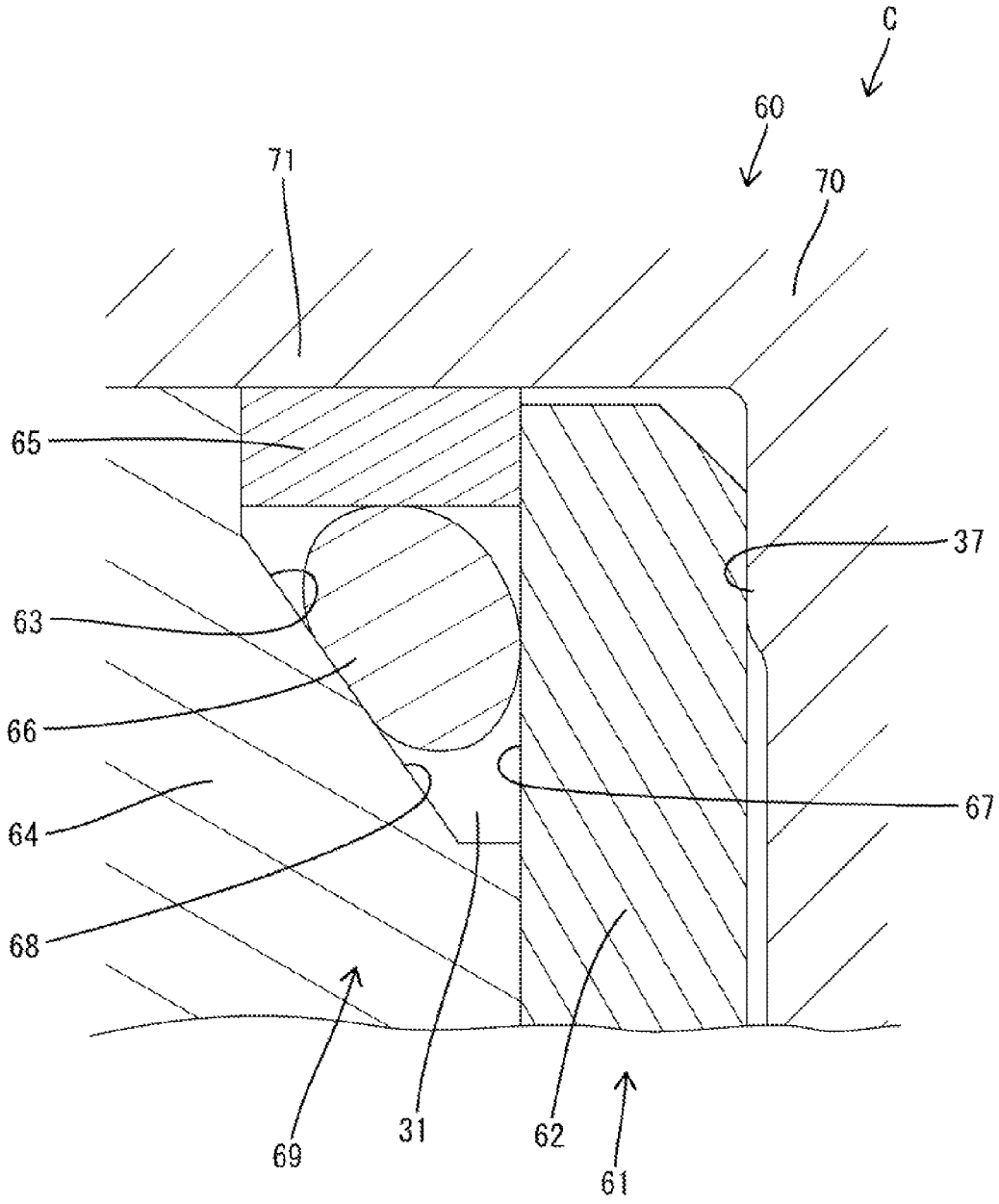
Figure 13:
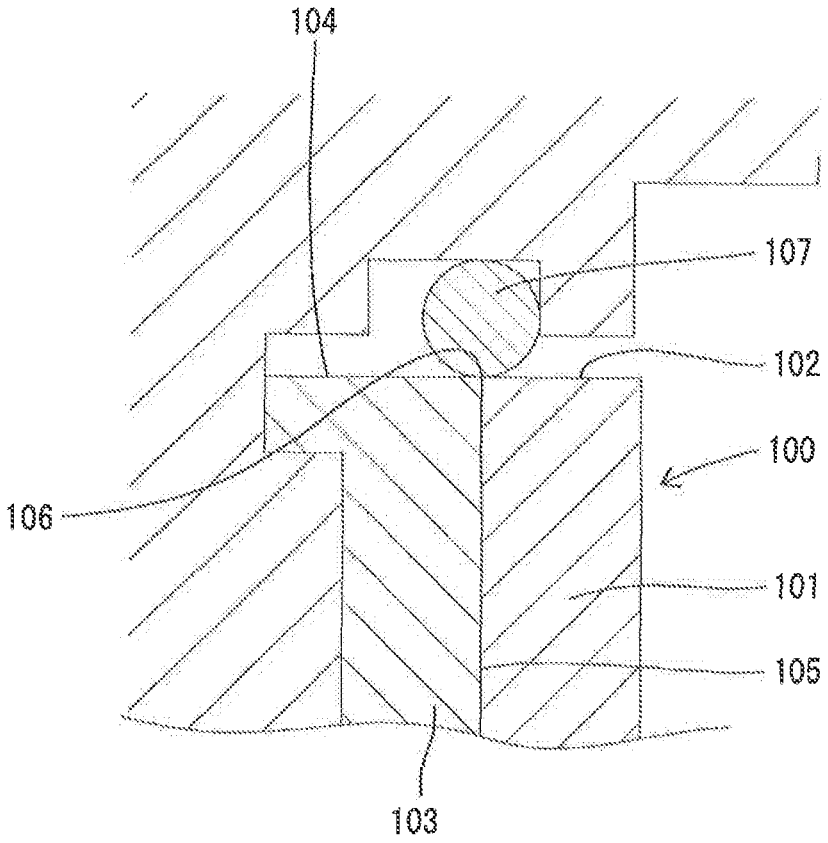
Fig.13 PRIOR ART
Figure 14:
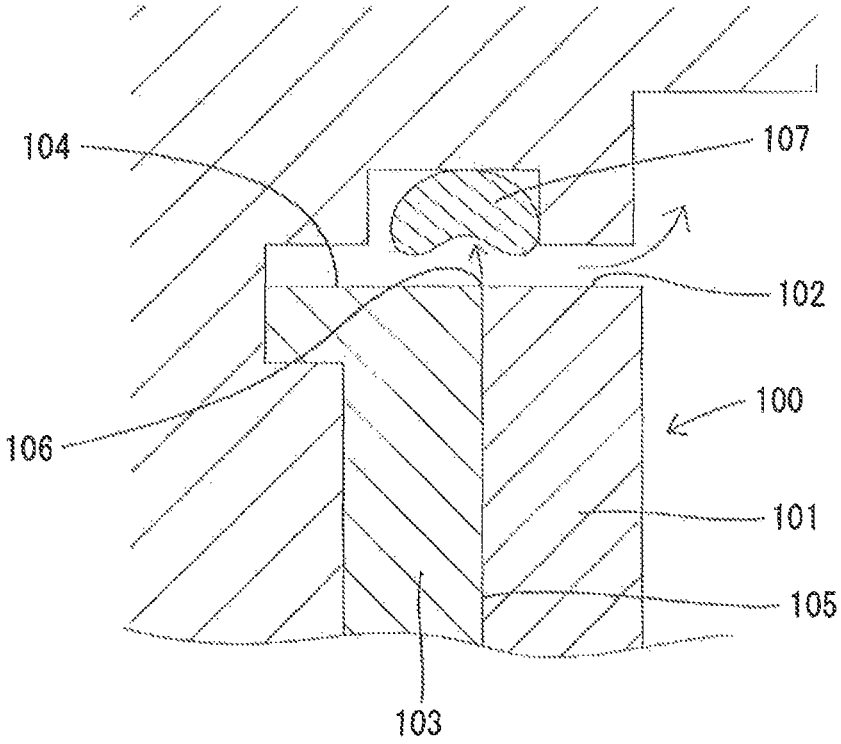
Fig.14 PRIOR ART

FIG., 2 is an enlarged cross-sectional view of the mouthpiece structure;

FIG. 3 is a partially enlarged cross-sectional view of the mouthpiece structure;

FIG. 4 is a partially enlarged cross-sectional view of the mouthpiece structure, showing the elastically deformed sealing member with increase in the fluid pressure;

FIG. 5 is a cross-sectional view of the liner formed in a die, showing a manufacturing process of the pressure vessel;

FIG. 6 is a cross-sectional view of integrated mouthpiece and liner, showing the manufacturing process of the pressure vessel;

FIG. 7 is a plan view of the spacer;

FIG. 8 is a cross-sectional view of the spacer;

FIG. 9 is a plan view of the retainer;

FIG. 10 is a cross-sectional view of the retainer;

FIG. 11 is a cross-sectional view of the mouthpiece structure according to a second embodiment;

FIG. 12 is a cross-sectional view of the mouthpiece structure according to a third embodiment;

FIG. 13 is a cross-sectional view of a conventional mouthpiece structure; and FIG. 14 is s cross-sectional view of the conventional mouthpiece structure, showing the irregularly deformed sealing member.

DETAILED DESCRIPTION

The retainer may have a peripheral wall surrounding an outer periphery of the cylindrical part. According to this construction, the cylindrical part is prevented from radially outward displacement by the peripheral wall even when the cylindrical part is subjected to a radially outward pressing force by the elastic resilience of the sealing member. This causes the sealing member to reliably adhere to the inner periphery of the cylindrical part and the outer periphery of the mouthpiece, with the result that a high sealing performance can be exhibited.

The peripheral wall of the retainer may have an inner periphery formed with a pressing portion configured to press the cylindrical part radially inward. According to this construction, the pressing action of the pressing portion can prevent a radially outward displacement of the cylindrical part even if elastic resilience of the sealing member applies a radially outward pressing force to the cylindrical part. This causes the sealing member to reliably adhere to the inner periphery of the cylindrical part and the outer periphery of the mouthpiece, with the result that a high sealing performance can be exhibited.

The pressing portion may foe disposed nearer to an opening of the housing recess than the sealing member. An amount of displacement of the cylindrical part becomes maximum at the opening of the housing recess when the elastic resilience of the sealing member displaces the cylindrical part radially outward. This construction can effectively prevent the radially outward displacement of the cylindrical part.

The housing recess may include an inward recess formed by recessing the inner periphery of the cylindrical part and an outward recess formed by recessing the outer periphery of the mouthpiece, and the inward recess may have a smaller radial depth than the outward recess. According to this construction, since a variation in the thickness of the cylindrical part made of the synthetic resin is smaller, shrinkage of the cylindrical part can be suppressed in the molding with the result of an improvement in the dimensional accuracy of the cylindrical part.

The retainer may be formed with a restricting protrusion housed in the housing recess. According to this construction, the retainer can be positioned relative to the mouthpiece and the cylindrical part when the restricting protrusion is housed in the housing recess.

The housing recess may be provided therein with a backup ring which abuts against or comes close to the sealing member from a side opposed to the sealed space thereby to oppose the sealing member. This construction can prevent the sealing member from being damaged by the contact with the retainer.

A first embodiment will be described with reference to FIGS. 1 to 10. The pressure vessel A of the first embodiment has a storage 10 for storing a fluid and a mouthpiece structure 15 serving as an inflow and outflow path of the fluid. The storage 10 has a double-layered structure including a vessel body 12 made of a synthetic resin and constituting a liner 11 and an outer layer (not shown) covering a surface of the vessel body 12. A mixed resin layer of high-density polyethylene (HDPE) and ethylene-vinyl alcohol copolymer resin (EVOH) can be used as a material of the liner 11, for example. A carbon fiber reinforced plastic (CFRP) can be used as a material of the outer layer, for example.

Figure 1:
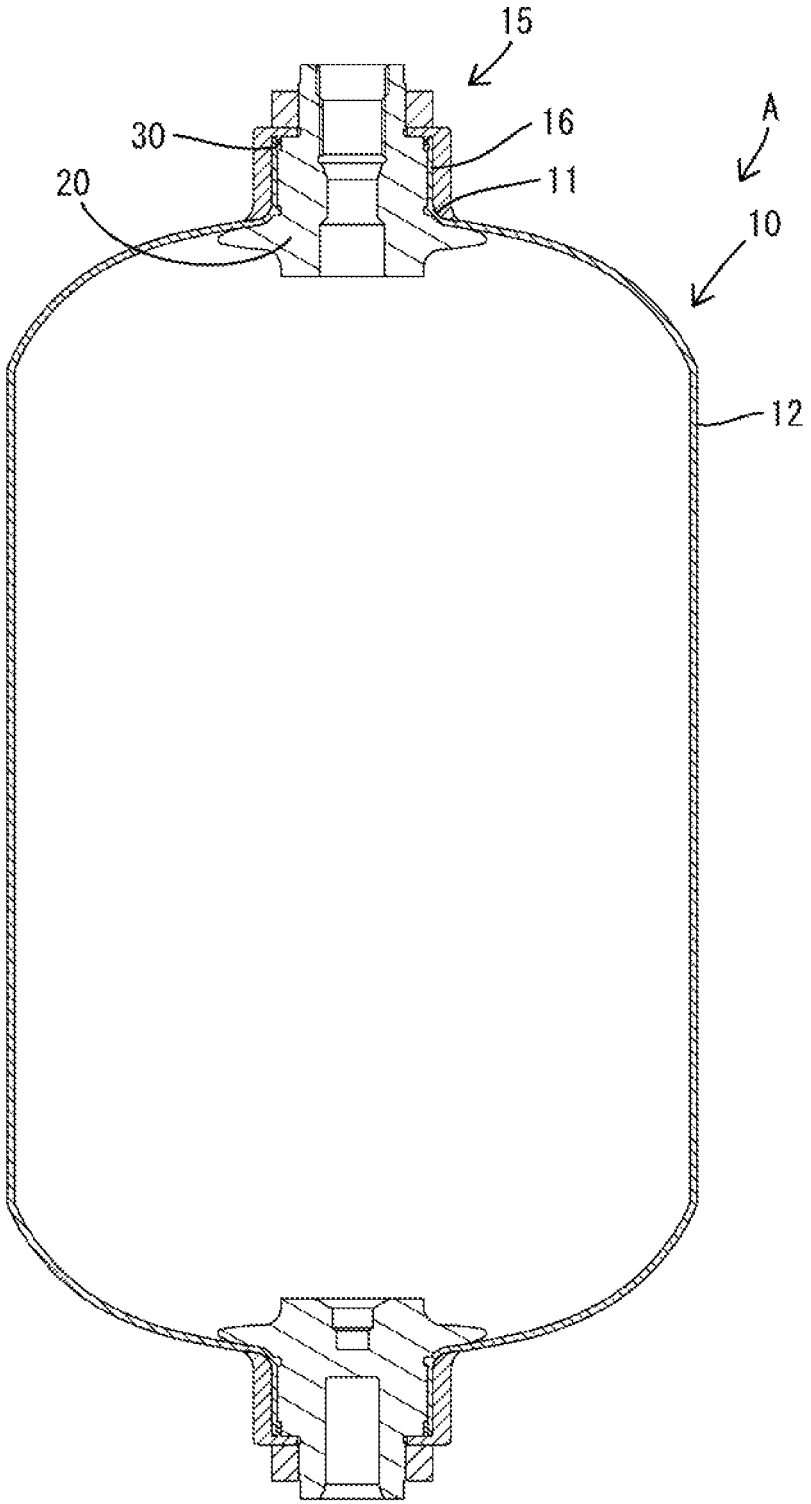
FIG. 1 is a cross-sectional view of the pressure vessel according to a first embodiment.
Figure 2:
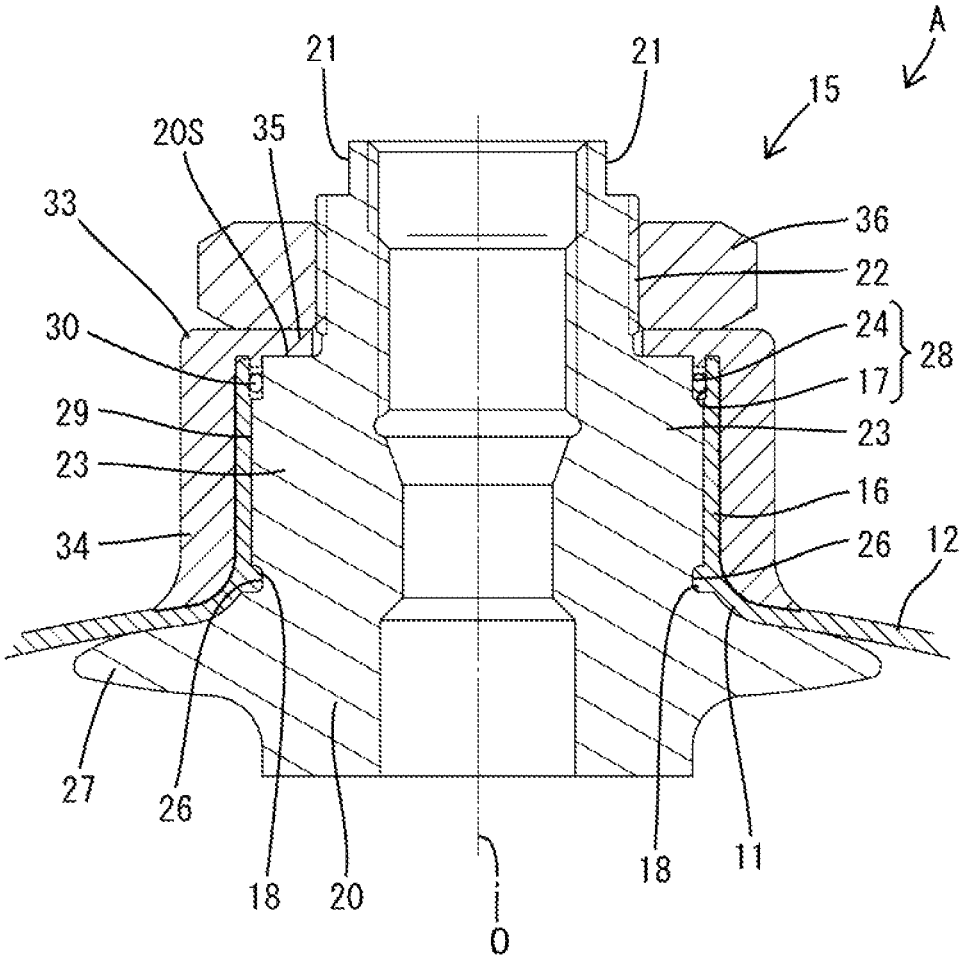

As shown in FIGS. 2 and 3, the mouthpiece structure 15 includes a cylindrical part 16 having a circular cross-section and constituting the liner 11, a mouthpiece 20, a sealing member 30, a backup ring 32, a retainer 33, a nut 36 and a valve (not shown). The cylindrical part 16 is formed integrally with the vessel body 12 and communicates between an interior and an exterior of the vessel body 12. The cylindrical part 16 has an inward recess 17 formed by recessing an inner peripheral distal end thereof over an entire circumference, as shown in FIGS. 3 and 4. The inward recess 17 is open to a distal end surface 16S (an external surface intersecting with axis lines of the cylindrical part 16) of the cylindrical part 16. The inward recess 17 has a cross-section that is normal to an axis line O of the cylindrical part 16 and has a circular shape. The inward recess 17 is coaxial with the mouthpiece 20. The inward recess 17 has a radial depth Da set to a relatively smaller value as shown in FIG. 3. The inward recess 17 has an inner periphery functioning as an inward sealing surface 19.

The mouthpiece 20 is generally formed into a cylindrical shape and has a hollow interior in which a valve (not shown) is to be mounted. As shown in FIG. 2, the mouthpiece 20 has an outer periphery including a most distal end side (an upper side in FIG. 2) formed with paired two parallel surfaces 21 to which a tool is to be fitted. The mouthpiece 20 has an outer periphery which includes a first region adjacent to a proximal end side (a lower side in FIG. 2) of the parallel surface 21. The first region is formed with a male thread 22 coaxial with the mouthpiece 20. The outer periphery of the mouthpiece 20 includes a second region adjacent to a proximal end side of the male thread 22. The second region serves as a larger diameter portion 23, which has a cross-section that is normal to the axis line O of the mouthpiece 20 and has a circular shape. The larger diameter portion 23 is coaxial with the mouthpiece 20. The larger diameter portion 23 has an end surface located at the male thread 22 side and serving as a stepped surface 20S (an outer surface intersecting with an axis line of the mouthpiece).

The larger diameter portion 23 has an outward recess 24 which is formed by recessing a distal end of an outer periphery thereof over an entire circumference and is open to the stepped surface 20S, as shown in FIGS. 3 and 4. The outward recess 24 has a cross-section that is normal to the axis line O of the mouthpiece 20 and has a circular shape. The outward recess 24 is coaxial with the mouthpiece 20 and has a radial depth Db which is set to be larger than the radial depth Da of the inward recess 17. The outward recess 24 has a peripheral surface serving as an outward sealing surface 25.

The larger diameter portion 23 has an outer peripheral proximal end formed with a plurality of circumferentially spaced cutouts 26, as shown in FIG. 2. Thus, the cutouts 20 are formed by partially cutting out the outer peripheral proximal end of the larger diameter portion 23. The outer periphery of the mouthpiece 20 has a region which is adjacent to the proximal end side of the larger diameter portion 23 and is formed with a circular flange 27 having a larger diameter than the larger diameter portion 23.

The mouthpiece 20 is formed integrally with the liner 11 so as to be coaxial with the cylindrical part 16, in the process of insert molding of the liner 11 (the vessel body 12 and the cylindrical part 16). As shown in FIG. 6, when the mouthpiece 20 is integrated with the liner 11, a region of the inner periphery of the cylindrical part 16 except for the inward recess 17 adheres closely to a region of the outer periphery of the larger diameter portion 23 except for the outward recess 24 in an airtight or liquidtight manner. Further, the vessel body 12 has an inner surface including a region which is adjacent to the cylindrical part 16 and adheres closely to a surface of the flange 27 in an airtight or liquidtight manner. Still further, the cylindrical part 16 has a plurality of lock protrusions 18 formed on an inner peripheral proximal end thereof. The lock protrusions 18 are fitted in the cutouts 26 of the mouthpiece 20 respectively. As the result of the fitting, the cylindrical part 16 (the liner 11) and the mouthpiece 20 are positioned so as to foe prevented from relative displacement in a direction of the axis line O and relative displacement in the circumferential direction.

The inward and outward recesses 17 and 24 are located at the same position in the direction of axis line O so as to be radially opposed to each other when the mouthpiece 20 and the liner 11 are in the integrated state. A part defining the inward recess 17 of the liner 11 and the outward recess 24 of the mouthpiece 20 serves as a housing part 39 to house the sealing member 30, as shown in FIGS. 3 and 4. The housing part 39 has an annular housing recess 28 formed by the inward and outward recesses 17 and 24. The housing recess 28 has a distal end open to a distal end surface 16S of the cylindrical part 16 and the stepped surface 20S of the mouthpiece 20. The housing recess 28 has a proximal end surface 28S tan end surface located opposite the distal end surface 16S and the stepped surface 20S). An interface 20 between the inner periphery of the cylindrical part 16 and the outer periphery of the mouthpiece 20 (the larger diameter portion 23) has a distal end facing the proximal end surface 28S. The interface 29 has a proximal end which faces an interior of the storage 10 (the vessel body 12) on an outer peripheral edge of the flange 27.

Accordingly, the interface 29 should be originally closed airtightly or liquidtightly to prevent the fluid in the storage 10 (the vessel body 12) from passing therethrough. However, a slight gap can occur in the interface 29 due to differences in the linear expansion coefficient in an environment with large temperature changes, pressure increase in the storage 10 and the like. In this case, the interface 29 having the gap is a leak path through which the fluid in the storage 10 leaks to the outside.

As a countermeasure, an elastically deformable sealing member 30 comprising a rubber O ring is housed in the housing recess 28. The sealing member 30 has a cross-section which intersects the circumferential direction of the sealing member 30 and has a perfectly circular or elliptical shape. The sealing member 30 adheres airtightly or liquidtightly to the peripheral surface (the inward sealing surface 19) of the inward recess 17 and the peripheral surface (the outward sealing surface 25) of the outward recess 24 continuously over an entire circumference. More specifically, the housing recess 28 is divided by the sealing member 30 into a distal end side and a proximal end side. An interior of the housing recess 28 includes a space which is located at the proximal end side relative to the sealing member 30 and serves as sealed space 31 defined by the sealing member 30 so that the distal end of the interface 29 (an downstream end of the leak path in the interface 29) between the inner periphery of the cylindrical part 16 and the outer periphery of the mouthpiece 20 faces the sealed space 31. When leaking through the leak path in the interface 29, the fluid in the vessel body 12 flows into the sealed space 31 to be blocked by the sealing member 30.

Further, the backup ring 32 is housed in the housing recess 28. The backup ring 32 is formed into an annular shape and abuts against or comes close to the sealing member 30 from the side opposed to the sealed space 31 (namely, the side open to the distal end surface 16S of the cylindrical part 16 and the stepped surface 20S of the mouthpiece 20) thereby to oppose to the sealing member 30. The backup ring 32 prevents the sealing member 30 in the housing recess 28 from moving to the side of the distal end surface 16S and the stepped surface 20S.

The retainer 33 is made of a metal material such as an aluminum alloy. The retainer 33 is formed into a cylindrical shape and is coaxial with the cylindrical part 16 and the mouthpiece 20. As shown in FIGS. 2, 9 and 10, the retainer 33 has a cylindrical peripheral wall 34 and a holding portion 35 projecting radially inward from a distal end of the peripheral wall 34 into the shape of an annular plate. The retainer 33 is assembled to the mouthpiece 20 and the cylindrical part 16 from the distal end side of the mouthpiece structure 15 to be fixed by the nut 36 threadingly engaged with the male thread 22 in the assembled state. When the retainer 33 is in the assembled state, the peripheral wall 34 abuts against or comes close to the cylindrical part 16 to surround the outer periphery of the cylindrical part 16 over an entire circumference, and the holding portion 35 abuts against the stepped surface 20S of the mouthpiece 20 and is located opposite the distal end surface 16S of the cylindrical part 16 in a non-contact state with a slight gap.

The peripheral wail 34 has an inner periphery with a distal end formed with a pressing portion 37 bulging radially inward. The pressing portion 37 is formed to be coaxial with the peripheral wall 34 (the cylindrical part 16). A forming range of the pressing portion 37 in the direction of axis line O covers a region corresponding to the distal end of the housing recess 28, that is, a region located at the distal end side relative to the sea ling member 30 (namely, a position nearer to an opening of the housing recess 28 than the sealing member 30). Further, the pressing portion 37 has a forming dimension set to be equal to or slightly smaller than an outer diameter of the distal end of the cylindrical part 16. The holding portion 35 has a restricting protrusion 38 which is coaxial with the mouthpiece 20 and the cylindrical part 16 and is formed into an annular shape. The restricting protrusion 38 is housed in the housing recess 28 and abuts against or comes close to the backup ring 32 to be located opposite the backup ring 32.

A process of forming the pressure vessel A will next be described. Firstly, a spacer 42 and the mouthpiece 20 are set in dies 40 and 41 as shown in FIG. 5. The spacer 42 has an annular portion 43 coaxial, with the mouthpiece 20 and an annular molding protrusion 44 which protrudes from an outer peripheral edge of the annular portion 43 to the proximal end side of the mouthpiece 20, as shown in FIGS. 7 and 8. The annular portion 43 is formed with a plurality of circumferentially spaced positioning holes 45. The spacer 42 is attached to the dies 40 and 41 while positioning pins 46 of the dies 40 and 41 are fitted in the respective positioning holes 45 so that the spacer 42 is positioned, as shown in FIG. 5. The mouthpiece 20 is attached to the dies 40 and 41 while the molding protrusion 44 is fitted in the outward recess 24 thereof. The molding protrusion 44 has an outer periphery projecting to the outer peripheral side of the mouthpiece 20 by a dimension corresponding to the inward recess 17.

When the spacer 42 and the mouthpiece 20 are set in the dies 40 and 41, molten resin is supplied into the dies 40 and 41 so that the liner 12 is molded. A blow molding method, an injection molding method or the like is carried out in the molding. The spacer 42 is removed when the resin has been hardened and the liner 11 has been molded. The housing recess 28 is formed upon, detachment of the spacer 42. The molding dies 40 and 41 used to mold the region of the liner 11 except for the inward recess 17 are opened, in a direction perpendicular to the axis line O of the mouthpiece 20 (the right-left direction in FIG. 5). Accordingly, a parting line (not shown) parallel to the axis line O would inevitably foe formed on the surface of the molded liner 11.

However, the peripheral surface (namely, the inward sealing surface 19) of the inward recess 17 constituting the housing recess 28 is molded by the spacer 42 moved in the direction parallel to the axis line O of the mouthpiece 20 and the Cylindrical part 16 but not by the molding dies 40 and 41 opened in the direction perpendicular to the axis line O. Accordingly, no parting line occurs on the inward sealing surface 19. Thereafter, the retainer 33 is assembled to the mouthpiece 20 and the liner 11, and the nut 36 is tightened so that the retainer 33 is fixed to the mouthpiece 20 and the liner 11. Further, a valve (not shown) is mounted to the mouthpiece 20. The manufacture of the mouthpiece structure 15 is completed.

When leaking through the interface 29 between the cylindrical part 16 and the larger diameter portion 23, the fluid stored in the storage portion 10 (the vessel body 12) flows into the sealed space 31, pressing the sealing member 30 against the distal end side. However, since the sealing member 30 is prevented from movement to the distal end side by the restricting protrusion 38 via the backup ring 32, the sealing member 30 is elastically deformed to increase a capacity of the sealed space 31 as shown in FIG. 4. More specifically, the sealing member 30 is pressed in the direction of the axis line O of the mouthpiece 20 and is elastically deformed to be radially spread. This elastic deformation increases the pressure in the region of the sealing member 30 where the sealing member 30 adheres closely to the outward sealing surface 25 of the mouthpiece 20 and the inward sealing surface 19 of the cylindrical part 16 and further increases an area of the sealing member 30 adherent to the outward sealing surface 25 of the mouthpiece 20 and an area of the sealing member 30 adherent to the inward sealing surface 19 of the cylindrical part 16. Consequently, the fluid in the housing recess 28 can reliably be prevented from leaking.

Further, the retainer 33 has the peripheral wall 34 surrounding the outer periphery of the cylindrical part 16. According to this construction, the peripheral wall 34 prevents the cylindrical part 16 from radially outward displacement even when the elastic restoring force of the sealing member 30 applies a radially outward pressing force to the cylindrical part 16. Moreover, since the pressing portion 37 is formed on the inner periphery of the peripheral wall 34 to press the cylindrical part 16 radially inward, the pressing action of the pressing portion 37 can reliably prevent the radially outward displacement of the cylindrical part 16. This can provide a reliable adhesion of the sealing member 30 to the inner periphery of the cylindrical part 16 and the outer periphery of the mouthpiece 20, with the result that a high sealing performance can be exhibited. Further, when the elastic restoring force of the sealing member 30 displaces the cylindrical part 16 radially outward, an amount of displacement of the cylindrical part 16 becomes maximum at the opening (that is, the distal end of the cylindrical part 16) of the housing recess 23. The pressing portion 37 is then disposed nearer to the opening of the housing recess 26 than the sealing member 30. This can effectively prevent radially outward displacement of the cylindrical part 16.

The mouthpiece structure 15 of the pressure vessel A of the first embodiment has the synthetic resin liner 11 constituting the vessel body 12 and the cylindrical part 16 communicating between the interior and the exterior of the vessel body 12, the cylindrical mouthpiece 20 mounted closely to the inner periphery of the cylindrical part 16 and the housing part 39 housing the sealing member 30. The housing part 39 is formed by recessing the inner periphery of the cylindrical part 16 and the outer periphery of the mouthpiece 20 and has the housing recess 28 open to the stepped surface 20S of the mouthpiece 20 and the distal end surface 16S of the cylindrical part 16. The sealing member 30 is housed in the housing recess 28 while being adherent close to the inner periphery of the cylindrical, part 16 and the outer periphery of the mouthpiece 20. Further, the sealed space 31 is defined by the sealing member 30 in the housing recess 28. The interface 29 between the inner periphery of the cylindrical part 16 and the outer periphery of the mouthpiece 20 face the sealed space 31. The mouthpiece structure 15 further includes the retainer 33 provided at the side opposed to the sealed space 31 with the sealing member 30 being interposed therebetween. The retainer 33 prevents the sealing member 30 from being deformed in the direction such that the capacity of the sealed space 31 is increased.

According to this construction, the sealing member 30 blocks, in the sealed space 31, the fluid flowing from the vessel body 12 into the housing recess 28 through the gap in the interface 29 between the cylindrical part 16 and the mouthpiece 20. Accordingly, the fluid is prevented from leaking outside the cylindrical part 16 and the mouthpiece 20. When the pressure of the fluid flowing info the sealed space 31 becomes excessively large, the sealing member 30 is elastically deformed so as to be pressed in the direction of the axis line O between the fluid and the retainer 33. This increases the adhesion of the sealing member 30 to the inner periphery of the cylindrical part 16 and the outer periphery of the mouthpiece 20. Accordingly, the fluid is reliably prevented from leaking.

The housing recess 28 includes the inward recess 17 formed by recessing the inner periphery of the cylindrical part 16 and the outward recess 24 formed by recessing the outer periphery of the mouthpiece 20. The inward, recess 17 has the radial depth Da that is set to be smaller than the radial depth Db of the outward recess 24. According to this construction, since variations in the thickness of the cylindrical part 16 made of the synthetic resin are small, shrinkage is suppressed in the molding of the cylindrical part 16 with the result that the dimensional accuracy of the cylindrical part 16 can be improved.

Further, the backup ring 32 is provided in the housing recess 23. The backup ring 32 abuts against or comes close to the sealing member 30 from the side opposed to the sealed space 31. As a result, the sealing member 30 can be prevented from being damaged by the contact with, the retainer 33 (the restricting protrusion 38). Further, the retainer 33 may be formed with the restricting protrusion 38 housed in the housing recess 28. According to this construction, the retainer 33 can be positioned relative to the cylindrical part 16 and the mouthpiece 20 by housing the restricting protrusion 38 in the housing recess 28.

A second embodiment will be described with reference to FIG. 11. The mouthpiece structure 50 for the pressure vessel B according to the second embodiment has no inward recess in the inner periphery of the cylindrical part 52 of the liner 51, which periphery defines the housing part 59. The housing recess 53 is formed by recessing the outer periphery of the mouthpiece 54 only. Further, a dimension of the housing recess 53 in the direction of the axis line O is set to be smaller than that of the housing recess 28 in the first embodiment. The backup ring 55 and the sealing member 56 both housed in the housing recess 53 are displaced to the distal end side (upper side in FIGS. 3, 4 and 11) relative to the positions in the first embodiment. Further, the retainer 57 differs in the shape from the retainer 33 in the first embodiment. More specifically, the retainer 57 has no part corresponding to the restricting protrusion 38 in the first embodiment, and the holding portion 58 of the retainer 57 is disposed to abut against or comes close to the backup ring 55 thereby to be opposed to the backup ring 55. Since the other construction in the second embodiment is identical with that in the first embodiment, identical ox similar parts are labeled by the same reference symbols as those in the first embodiment. The description of the structure, working and effect of these identical parts will be eliminated.

A third emboli mono will be described with reference to FIG. 12. The mouthpiece structure 60 for the pressure vessel C according to the third embodiment has no inward recess in the inner periphery of the cylindrical part 62 of the liner 61, which periphery defines the housing part 69. The housing recess 63 is formed by recessing the outer periphery of the mouthpiece 64 only. Further, a dimension of the housing recess 63 in the direction of the axis line O is set to be smaller than that of the housing recess 28 in the first embodiment. The backup ring 65 and the sealing member 66 both housed in the housing recess 63 are displaced to the distal end side relative to the positions in the first embodiment. Further, although the inner periphery of the cylindrical part 62 has an inward sealing surface 67 that is parallel to the axis line O of the mouthpiece 64 in the same manner as in the first embodiment, an outward sealing surface 68 of the outer periphery of the mouthpiece 64 is inclined relative to the axis line O of the mouthpiece 64. Accordingly, the housing recess 63 has a radial, dimension increased to the distal end side. Further, the retainer 70 in the third embodiment has no part corresponding to the restricting protrusion 38 in the first embodiment, and the holding portion 71 of the retainer 70 is disposed to abut against or come close to the backup ring 65 thereby to be opposed to the backup ring 65. Since the other construction in the third embodiment is identical with that in the first embodiment, identical or similar parts are labeled by the same reference symbols as those in the first embodiment. The description of the structure, working and effect of these identical parts will be eliminated.

The foregoing embodiments should not be restrictive but may be modified or expanded as follows.

(1) Although the displacement of the sealing member to the outer surface side is prevented by housing the restricting protrusion formed on the retainer in the first, embodiment, the retainer may prevent displacement of the sealing member to the outer surface side without the forming of a part to be housed in the housing recess.

(2) Although the radial depth of the inward recess of the cylindrical part is set to be smaller than that of the outward recess of the mouthpiece in the first embodiment, the inward and outward recesses may have the same radial depth, or the radial depth of the inward recess of the cylindrical part is set to be larger than that of the outward recess of the mouthpiece in the first embodiment.

(3) Although the space constituting the housing recess is made up of the inward recess formed by recessing the cylindrical part and the outward recess formed by recessing the mouthpiece in the first embodiment, the space constituting the housing recess may be made up of only the inward recess formed by recessing the cylindrical part or only the outward recess formed by recessing the mouthpiece.

(4) Although the retainer is formed with the pressing portion in each of the first to third embodiments, the retainer may not have a pressing portion.

(5) Although the retainer and the nut are parts independent of each other in each of the first to third embodiments, the retainer and the nut may be a single part.

(6) Although the outer surface (the distal end surface) of the cylindrical part to which the housing recess is open is a plane perpendicular to the axis line in each of the first to third embodiments, the outer surface may be a plane inclined relative to the axis line or a curved surface intersecting the axis line.

(7) Although the outer surface (the stepped surface) of the mouthpiece to which the housing recess is open is a plane perpendicular to the axis line in each of the first to third embodiments, the outer surface may be a plane inclined relative to the axis line or a curved surface intersecting the axis line, (8) Although the forming range of the pressing portion in the direction of the axis line of the mouthpiece is the region at the distal end side relative to the sealing member, namely, the region not corresponding to the sealing member, in each of the first to third embodiment, the forming range of the pressing portion may be a region corresponding to a part of or an entire sealing member.

(9) Although the retainer prevents the sealing member from displacement to the outer surface side without the part being housed in the housing recess in each of the second and third embodiments, the displacement of the sealing member to the outer surface side may be prevented by housing in the housing recess a restricting protrusion formed on the retainer.

(10) Although the space constituting the housing recess is made up of only the outward recess formed by recessing the mouthpiece, in each of the second and third embodiments, this space may be made up of only the inward recess formed by recessing the cylindrical part or made of an inward recess formed by recessing the cylindrical part and an outward recess formed by recessing the mouthpiece together.

While particular embodiments have been described herein for purposes of illustration, many modifications and changes will become apparent to those of skilled in the art. Accordingly, the appended claims are intended to encompass ail such modifications and changes.

What is claimed is:

1. A mouthpiece structure for a pressure vessel, comprising:

a liner made of a synthetic resin and constituting a vessel body and a cylindrical part communicating between an interior and an exterior of the vessel body;

a cylindrical mouthpiece mounted closely to an inner periphery of the cylindrical part;

a housing part having a housing recess formed by recessing at least one of the inner periphery of the cylindrical part and an outer periphery of the mouthpiece, the housing recess being open to an external surface intersecting with axis lines of the cylindrical part and the mouthpiece, wherein the housing recess includes an inward recess formed by recessing the inner periphery of the cylindrical part and an outward recess formed by recessing the outer periphery of the mouthpiece, and the inward recess has a smaller radial depth than the outward recess;

a sealing member housed in the housing recess while adhering closely to the inner periphery of the cylindrical part and the outer periphery of the mouthpiece, the sealing member defining a sealed space facing an interface between the inner periphery of the cylindrical part and the outer periphery of the mouthpiece in the housing recess; and a retainer provided opposite the sealed space with the sealing member being interposed therebetween and preventing the sealing member from being displaced in a direction such that the sealing member increases a capacity of the sealed space.

2. The structure according to claim 1, wherein the retainer has a peripheral wall surrounding an outer periphery of the cylindrical part.

3. The structure according to claim 2, wherein the peripheral wall of the retainer has an inner periphery formed with a pressing portion configured to press the cylindrical part radially inward.

4. The structure according to claim 3, wherein the pressing portion is disposed nearer to an opening of the housing recess than the sealing member.

5. The structure according to claim 1, wherein the retainer is formed with a restricting protrusion housed in the housing recess.

6. The structure according to claim 1, wherein the housing recess is provided therein with a backup ring which abuts against or comes close to the sealing member from a side opposed to the sealed space thereby to oppose the sealing member.

* * * * *